US005291739A

United States Patent [19]

Woods et al.

[11] Patent Number: 5,291,739

[45] Date of Patent: Mar. 8, 1994

[54] ADJUSTABLE ALIGNMENT FOR CRYOGEN VENTING SYSTEM FOR SUPERCONDUCTING MAGNET

[75] Inventors: Daniel C. Woods; William S. Stogner; Robert R. Carey, all of Florence, S.C.

[73] Assignee: General Electric Company, Milwaukee, Wis.

[21] Appl. No.: 905,955

[22] Filed: Jun. 29, 1992

[51] Int. Cl.[5] ..... F17C 7/04

[52] U.S. Cl. ..... 62/48.1; 62/511; 220/745; 505/892

[58] Field of Search ..... 62/45.1, 48.1, 51.1; 220/745

[56] References Cited

U.S. PATENT DOCUMENTS 3,121,999 2/1964 Kastbohm et al. ..... 62/48.1
3,279,198 10/1966 Ayers et al. ..... 62/48.1
3,965,689 6/1976 Brown et al. ..... 62/48.1
4,350,017 9/1982 Kneip et al. ..... 62/48.1
5,117,640 6/1992 Grinfrida, Jr. ..... 62/48.1

FOREIGN PATENT DOCUMENTS 380908 5/1973 U.S.S.R. .

*Primary Examiner*—Ronald C. Capossela
*Attorney, Agent, or Firm*—Irving Freedman; James O. Skarsten

[57] ABSTRACT

An adjustable alignment assembly for a cryogen venting system for a superconducting magnet including a radially adjustable floating flange connection with a cryogenic seal to enable precise alignment of the cryostat vent pipe with the ceiling vent pipe of the room in which the superconducting magnet is installed.

12 Claims, 4 Drawing Sheets

ADJUSTABLE ALIGNMENT FOR CRYOGEN VENTING SYSTEM FOR SUPERCONDUCTING MAGNET

BACKGROUND OF THE INVENTION

This invention relates to an adjustable alignment assembly for the cryogen venting system for a superconducting magnet, particularly suitable for connecting the cryostat vent to the atmospheric vent in the room in which the superconducting magnet is installed.

As is well known, a magnet can be made superconductive by placing it in an extremely cold environment, such as by enclosing it in a cryostat or pressure vessel containing liquid helium or other cryogen. The extreme cold reduces the resistance in the magnet coils to negligible levels, such that when a power source is initially connected to the coil (for a period, for example, of ten minutes) to introduce a current flow through the coils, the current will continue to flow through the coils due to the negligible resistance even after power is removed, thereby maintaining a magnetic field. Superconducting magnets find wide application, for example, in the field of magnetic resonance imaging (hereinafter "MRI").

MRI systems and equipment are typically installed in specially designed hospital rooms or units which include appropriate shielding and isolation from extraneous magnetic fields and a vent to the atmosphere, generally through the ceiling of the room, all of which are designed and usually prepared in advance of the delivery and installation of the MRI. When the MRI is positioned and installed at the user or customer site, the vent adapter on the MRI must be connected by piping to the previously installed piping in the ceiling of the installation. This enables the helium gas resulting from the boil-off of the liquid helium to be vented through the ceiling of the building or hospital in which the MRI is installed to the atmosphere outside the building.

Careful consideration must be directed not only to conducting the normal boil-off of helium gas to the atmosphere which under normal operating conditions is a very low flow such as in the order of 0.2 liters per hour, but also to the extremely heavy helium gas flow of up to 9000 grams per second, and high pressures in the order of 35–40 pounds per square inch gauge (psig) which occurs if the superconducting magnet should quench or revert to a non-superconducting state. It is important that the venting system safely carry off the helium gas vapor under both conditions, without allowing any significant leak of helium gas into the MRI imaging room or rupture of the venting system in the event of a magnet quench.

Notwithstanding careful and precise dimensioning and design in advance of installation, the magnet vent adapter frequently does not precisely line up with the ceiling vent pipe which is already installed and cannot be moved. This results because the precise location of the superconducting magnet in the MRI imaging room is predetermined by the location of the magnet mounting bolts that have already been set in place by the building contractor. Thus, the need arises for a vent pipe interconnecting system which is capable of compensating for the final small vent system misalignment which is generally in the order of less than one inch of variation in any radial direction.

The use of flexible piping such as stainless steel "corrugated" piping somewhat similar in appearance to that used to connect dryers in a home to a vent, has proven difficult to use since the stainless steel, even with corrugations, is not really flexible over the short length often required. Flexible alternative materials do not have sufficient strength or cryogenic resiliency in the event of a superconducting magnet quench.

It is thus highly desirable that the vent interconnecting system provide lateral movement between the building vent pipe and the MRI vent adapter.

However, it is necessary that the adjustable vent piping be gas-tight, and suitable for carrying cryogen boil-off even in the event of quenching of the magnet, in which as much as 1800 liters of helium may be boiled off in a matter of only 20 seconds, producing tremendous volumes and pressures of cryogenic temperature cryogen gas.

OBJECTS AND SUMMARY OF INVENTION

Accordingly, it is an object of the present invention to provide a superconducting magnet cryostat venting system with simple lateral adjustment for alignment between the cryostat vent and the ceiling vent to the atmosphere.

It is another object of the present invention to provide an adjustable superconducting magnet cryostat venting system which is leak-tight and will withstand the pressures of quenching of the superconducting magnet.

Still another object of the present invention is to provide an adjustable superconducting magnet cryostat venting system which will withstand the temperature extremes encountered in operation, including the temperature extremes of quenching of the superconducting magnet.

It is yet another object of the present invention to provide an adjustable superconducting magnet cryostat venting system which can withstand, and which requires no replacement after, quenching of the superconducting magnet.

In accordance with a preferred embodiment of the present invention, a floating flange is provided intermediate the vent adapter attached to the cryostat and the vent pipe connected to the exhaust vent in the ceiling of the room in which the superconducting magnet is installed and which exhausts cryogen boil-off gas to the atmosphere. The vent pipe includes a slotted flange and a clamping ring about the side above the slotted flange with a plurality of bolts extending through openings in the clamping ring and through the slots to threaded apertures in the vent adapter flange. A resilient O-ring is positioned between the vent pipe flange and the vent adapter flange such that tightening the bolts provides a gas-tight joint. The diameter of the vent pipe is larger than the diameter of the vent adapter pipe and the difference in size is in the order of the width of the slots in the vent pipe flange. The vent pipe may be in the order of two inches larger in inside diameter than the vent pipe adapter, and the slots in the vent pipe flange may also be in the order of two inches to enable lateral adjustment of the alignment of the vent pipe by approximately one inch in all directions.

A dielectric isolator is provided between the vent pipe and the ceiling vent pipe to isolate the assembly from magnetic and radio waves. Upon positioning of the superconducting magnet and MRI within its designated room and with as close as possible alignment between the axis of the vent adapter and the axis of the ceiling vent, the subject invention provides precise alignment adjustment to obtain the necessary additional precise alignment without further attempts to correct any misalignment between the vent pipe adapter and the ceiling vent by attempting to move the bulky and heavy superconducting magnet relative to the ceiling vent.

BRIEF DESCRIPTION OF INVENTION

Figure 1:
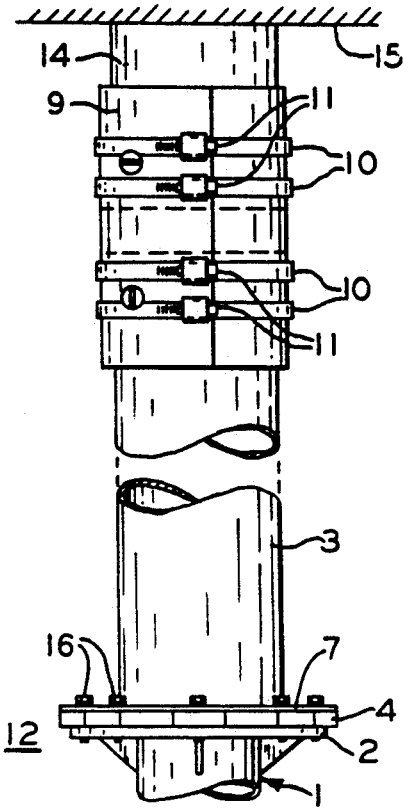
FIG. 1 shows the connection between the vent pipe adapter and the ceiling vent in accordance with the present invention.
Figure 2:
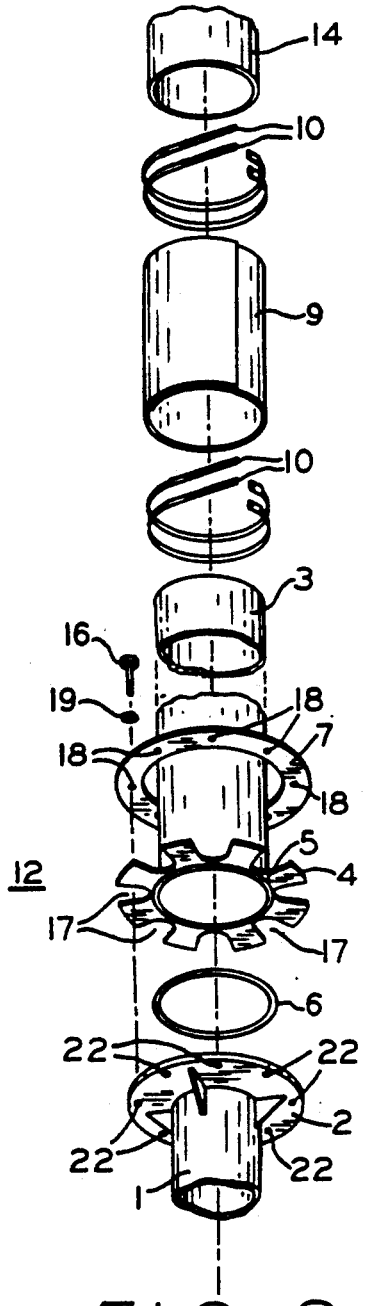
FIG. 2 is an exploded perspective view of the elements of FIG. 1.
Figure 3:
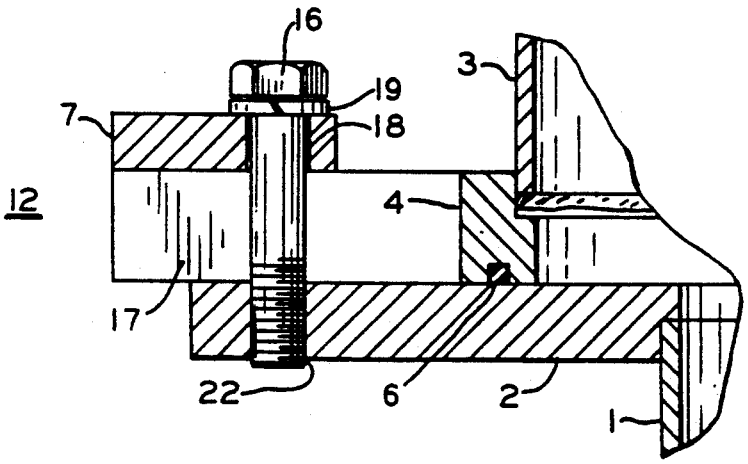
FIG. 3 is an enlarged cross-sectional view of a portion of the adjustable floating flange arrangement of FIGS. 1 and 2.
Figure 4:
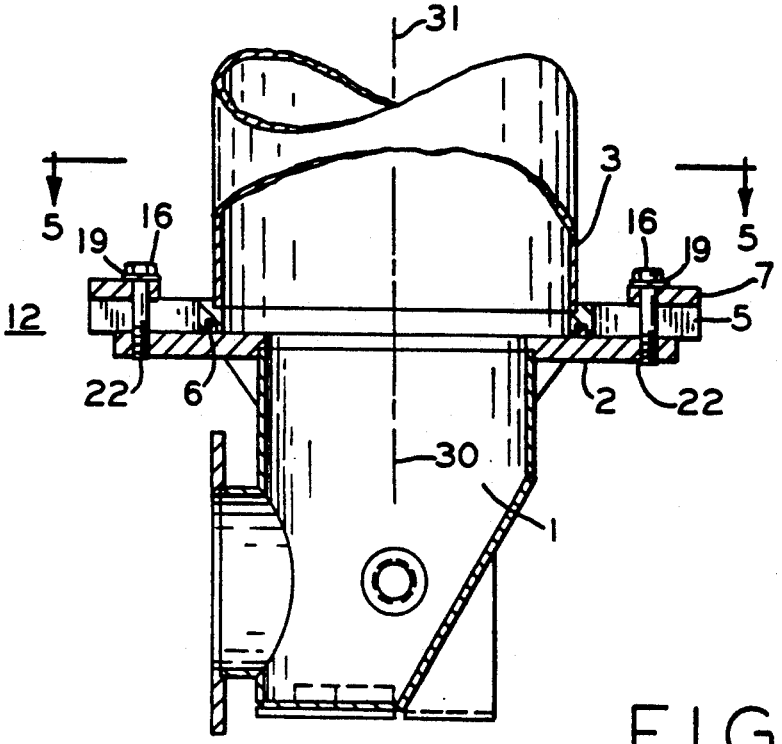
FIG. 4 is an enlarged sectional view of the vent adapter of FIGS. 1 and 2 showing connections to the cryostat, and in which the vent adapter and vent pipe are in alignment.

Referring first to FIGS. 1-4 and 8, the vent adapter 1 secured to cryostat 20 (see FIG. 4) includes flange 2 remote from the cryostat and a plurality of circumferentially spaced threaded apertures 22. Clamping ring 7 above flange 4 of vent pipe 3 includes a plurality of spaced apertures 18 which are aligned with threaded apertures 22 in flange 2 of vent adapter 1. Bolts such as 16 pass through washers 19 and apertures 18 for securing to threaded apertures 22 in order to secure vent pipe 3 to vent adapter 1. As best shown in FIGS. 1 and 4, vent pipe 3 is of a larqer internal diameter than vent adapter 1, and flanqe 4 of the vent pipe has a larqer diameter than the flange 2 of the vent adapter. In accordance with the present invention, and as described in detail below, vent pipe 3 is moveable laterally relative to vent pipe 1 through the provision of floating flange apparatus 12.

As best shown in FIGS. 1 and 2, vent pipe 3 is connected through dielectric isolating connector 9 to ceiling exhaust vent or pipe 14 which passes through ceiling 15 of the MRI room and typically through further piping of the venting system to the atmosphere outside of the MRI room. It is formed by wrapping a heavy glass fabric, double-coated with DuPont Neoprene with a fire-retardant coating. The material exhibits strong tensile strength while being water- and heat-resistant. A suitable material is that manufactured by Vent Fabrics, Inc., and sold under their stock number eight-inch Ventglas. This material is eight inches wide and is wrapped around the joint formed between vent pipe 3 and ceiling vent 14, after which it is secured in place by a plurality of adjustable strap clamps 10, the adjustment of which is provided through adjustment screws 11.

Figure 8:
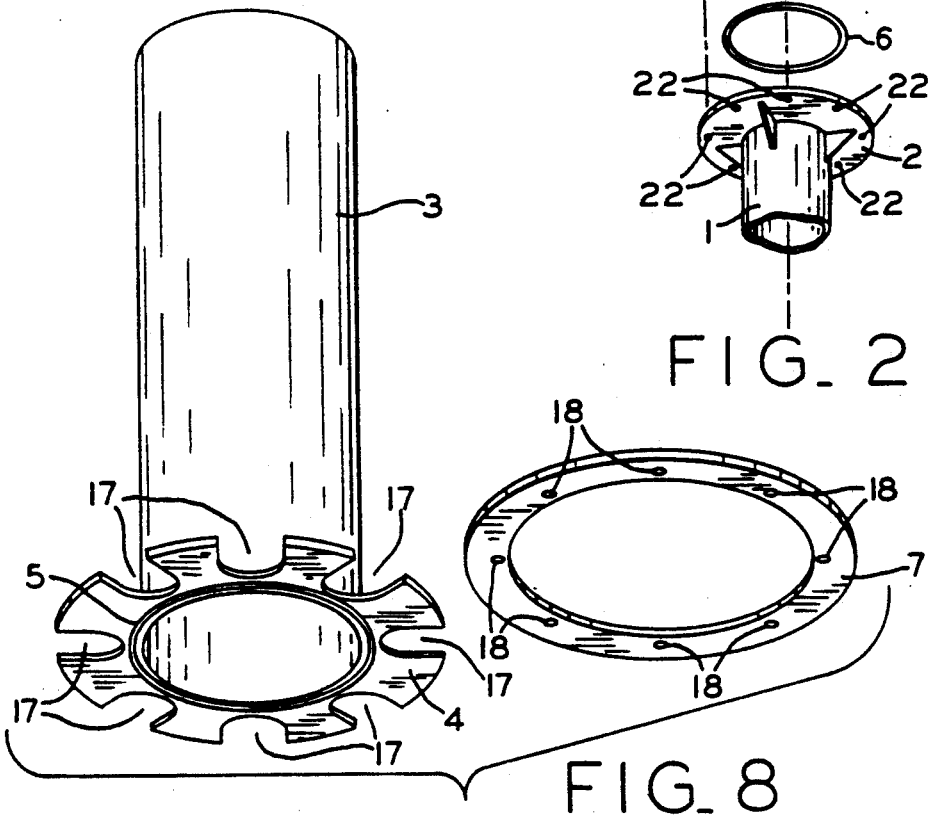
FIG. 8 is an enlarged view of components of the floating flange of FIGS. 1 and 2.

As best shown in FIGS. 2, 3 and 8, an O-ring 6 is positioned within an annular groove 5 in flange 4 of vent pipe 3, and is compressed between flange 4 and flange 2 of vent adapter 1 upon the tightening of bolts 16 into the threaded apertures 22. Washers 19 may conveniently be lock washers to maintain the assembly in a secure position after proper alignment is obtained.

FIG. 4 also shows the connection of vent adapter 1 to the cryostat. Referring to FIG. 4, vent adapter 1 is connected through burst disc 26 and pipe 29 to service turret 28. Burst disc 26 ruptures in the event that cryogen gas pressure builds up within the interior of helium vessel 23, the outer walls of which are shown. Such a pressure build-up could result if the superconducting magnet (not shown) within helium vessel 23 should quench, rapidly boiling off the liquid helium within the helium vessel. Since pipe 29 has a three-inch inside diameter, it enables rapid flow of the helium gas through vent adapter 1 and vent pipe 3 through ceiling vent 14 (see FIG. 1) to the atmosphere outside the superconducting magnet room. The burst disc 26 can be replaced after a superconducting magnet quench.

However, during normal operation of the superconducting magnet, burst disc 26 provides a barrier between pipe 29 and vent adapter 1 and the much smaller helium gas boil-off flow is conducted through exhaust line 27 around burst disc 26 to the vent adapter. It is to be noted that exhaust line 27 is relatively small in diameter, but is adequate to carry the small helium gas boil-off flow during normal or persistent superconducting magnet operation.

Figure 5:
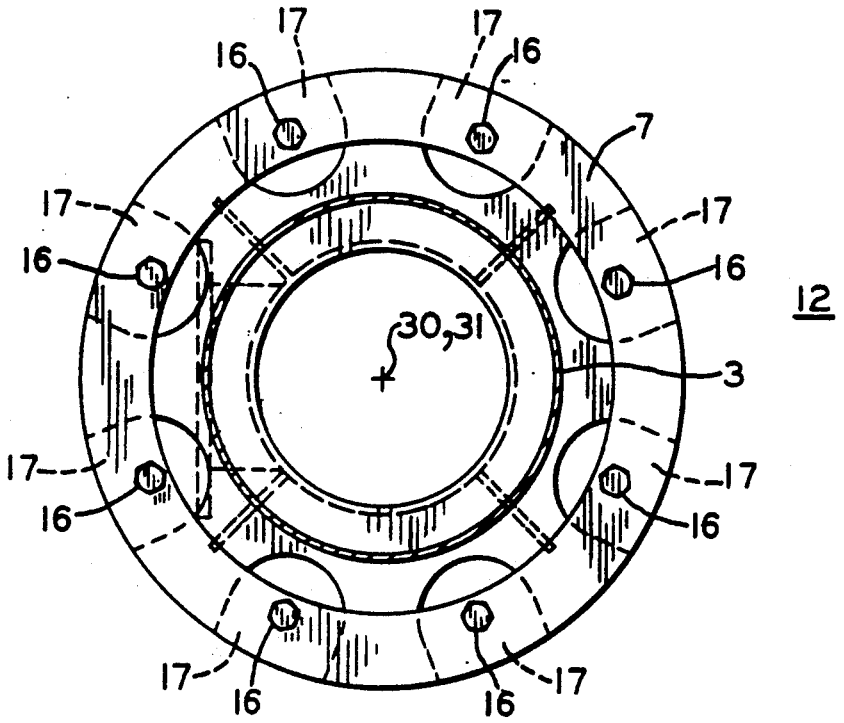
FIG. 5 is a top view of FIG. 4.
Figure 9:
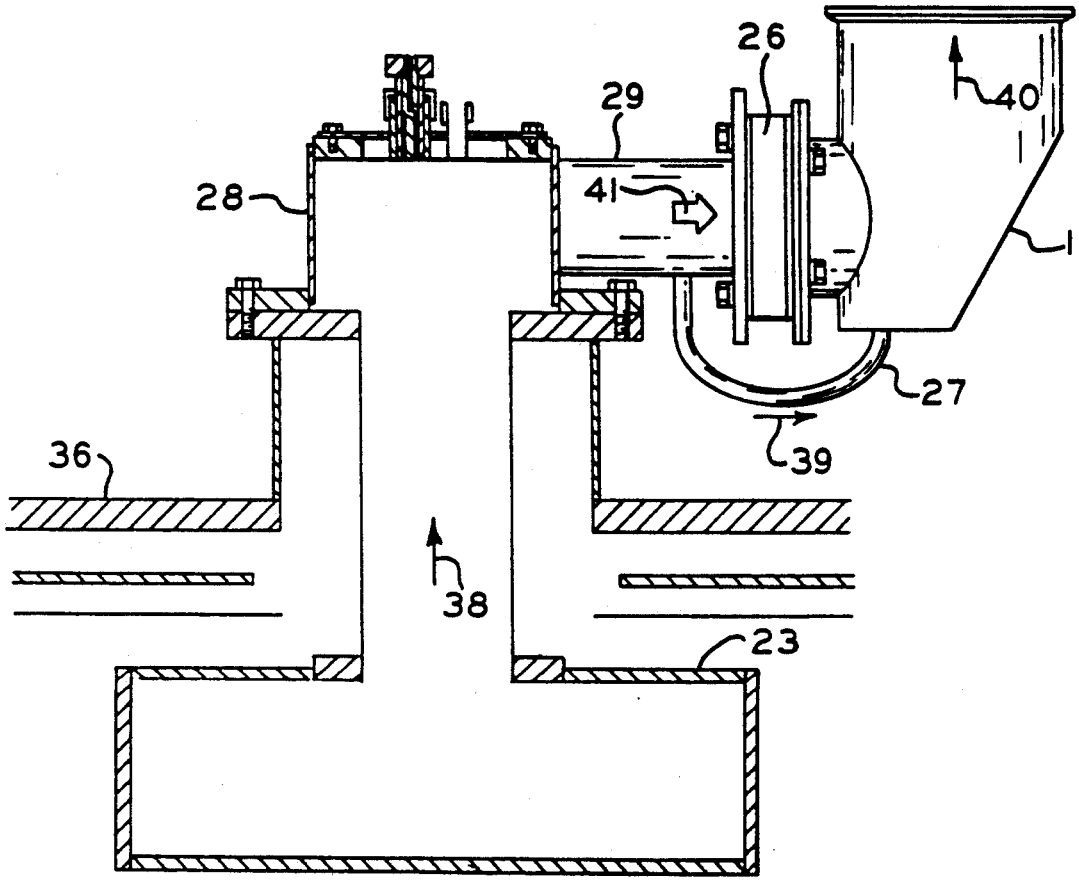
FIG. 9 is a pictorial view of an application of the present invention.

Referring next to FIGS. 4 and 5, in which vent adapter 1 is in alignment with vent pipe 3 and axis 30 of the vent adapter coincides with axis 31 of the vent pipe and bolts 16 are positioned centrally within adjustment slots 17. These figures represent the relative positioning of the vent adapter 1 and vent pipe 3 in the unlikely event that the superconducting magnet was placed within the MRI room with vent adapter 1 in precise alignment with the ceiling vent 14. However, since such precise alignment is highly unlikely, the equipment is installed initially with the vent pipe 3 centered over the vent adapter 1 as shown in FIGS. 4 and 5. This allows and facilitates lateral adjustment in any radial direction for the final "fine-tuning" of the alignment between vent pipe 3 and ceiling exhaust pipe 14 (also see FIG. 1).

The MRI superconducting magnet is positioned by the previously installed magnet mounting bolts and can not be adjusted. Accordingly the final adjustment of the alignment of the venting system is made by the lateral movement of vent pipe 3 after bolts 16 have been loosened.

Figure 6:
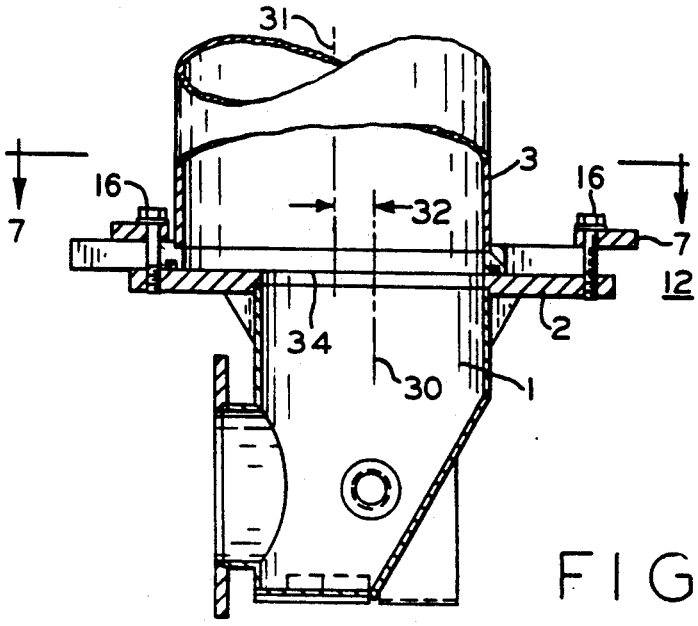
FIG. 6 is a portion of FIG. 4 in which the vent adapter and vent pipe are out of alignment.
Figure 7:
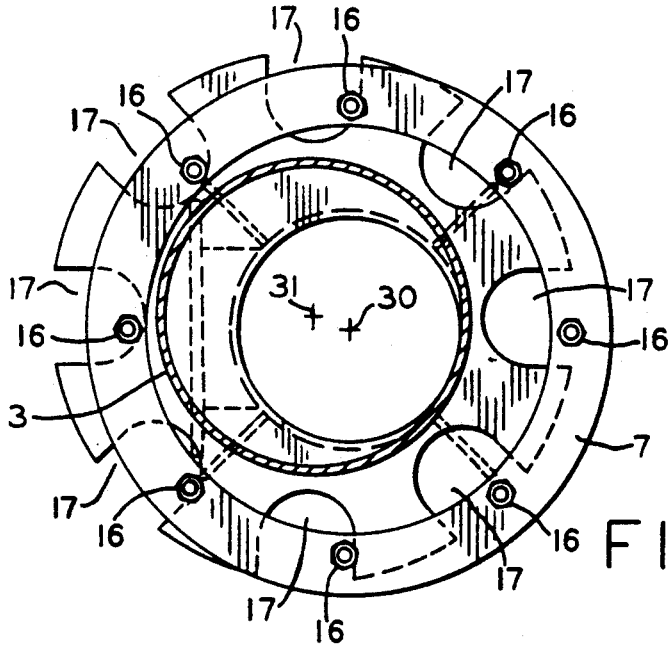
FIG. 7 is a top view of FIG. 6.

FIGS. 6 and 7 are to be compared with FIGS. 4 and 5 and show the lateral or radial movement of vent pipe 3 relative to vent adapter 1 in order to more precisely obtain alignment of vent pipe 3 with ceiling vent pipe 14. FIGS. 6 and 7 show the movement of vent pipe 3 to the left such that axis 31 of the vent pipe is displaced from axis 30 of vent adapter 1 by the distance shown by arrows 32 in FIG. 6 to place the vent pipe in alignment with ceiling vent pipe 14. Since vent pipe 3 is of a larger internal diameter than vent adapter 1 (two inches larger in one embodiment of the invention), it is possible to laterally adjust vent pipe 3 from its central position (a distance of up to one inch in that embodiment) while still maintaining a positive yet unrestricted connection between vent adapter 1 and vent pipe 3. It is undesirable to restrict the flow of cryogen gas through the interface 34 between vent adapter 1 and vent pipe 3 because of the extreme pressures and high helium gas flow generated during a superconducting magnet quench during which as much as 1800 liters of liquid helium is boiled off in a period as short as 20 seconds, and a constriction at the interface could result in damage to the venting system and possible release of heavy volumes of cryogenic helium gas into the hospital. Since the vent pipe 3 and other vent pipes are normally fabricated from 6061-T6 aluminum, they provide adequate strength even in the presence of a magnet quench.

Upon the proper and precise alignment of vent pipe 3 with ceiling vent 14, the floating flange assembly 12 is secured in position by tightening nuts 16, compressing O-ring 6 between flanges 7 and 2 of vent pipe 3 and vent adapter 1, respectively, providing a gas-tight and secure seal and connection.

If desired, vent pipe 3 could be tapered at its end remote from floating flange 12 to the diameter of ceiling vent 14. That is, by way of example, if the internal diameter of vent adapter 1 is six inches, and the internal diameter of the bottom portion of vent pipe 3 adjacent floating flange 12 is eight inches, vent pipe 3 could taper at the top to six inches to match the six-inch internal diameter of ceiling vent pipe 14. Since flow is always in one direction, that is, from six-inch vent adapter 1 to eight-inch vent pipe 3, the assembly does not constrain the flow through the six-inch vent adapter.

Clamping ring 7 has an inside diameter larger than the outside diameter of vent pipe 3 to enable lateral movement within the interior of the clamping ring. That is, in the example given, the inside diameter of the clamping ring should be at least two inches larger than the outside diameter of vent pipe 3 to allow one inch of movement in any direction. The clamping ring bolt circle which includes apertures 18 through which bolts 16 pass is positioned close to the inside diameter of clamping ring 7 in order to maximize the clamping force generated by bolts 16 and transferred through the clamping ring and flange 4 of vent pipe 3 to the O-ring 6 area. Also, there should be adequate flatness and surface finish on the mating surfaces of flanges 2 and 4, and in particular on flange 2, to allow the O-ring to seal.

The O-ring must function at cryogenic temperatures even during a magnetic quench such that the O-ring maintains a seal under such conditions. That is, the O-ring 6 must be capable of sustaining cryogenic temperatures in the order of −270° C. Ordinary rubber would crack at such extremely low temperatures. O-ring 6 is accordingly fabricated with a silicone core with Teflon coating. While this provides a resilience similar to rubber, the Teflon protects the O-ring from the cryogenic temperatures and provides adequate sliding and compression characteristics. It is to be appreciated that the O-ring is positioned between the flanges 2 and 4 of vent adapter 1 and vent pipe 3, respectively, such that their relative movement during alignment of the flanges relative to one another and movement of heavy steel piping over the O-ring. As such, it is important that the O-ring be capable of sustaining the sliding frictional forces while being compressed, and also be able to withstand the cryogenic temperatures as described above.

It is to be noted that the dimensions, location, and geometry of clamping ring 7, the clamping ring bolt circle diameter, and adjustment slots 17 are related so as to maintain a portion of the inside diameter of vent pipe 3 in direct connection and alignment with the full inside diameter of vent adapter 1 preventing any restriction or diminution of the inside diameter or size of the flow path of the venting system as the cryogen boil off gas passes from the superconducting magnet through the venting system to the atmosphere outside the MRI imaging room. The helium gas flow is thus not constrained between vent pipe 3 and vent adapter 1 by any adjustment of the venting system and the flow velocity is not altered because of any such constraint.

While the present invention has been described with respect to certain preferred embodiments thereof, it is to be understood that various and numerous variations in the details of construction, the arrangement and combination of parts, and the type of material used may combination of parts, and the type of material used may be made without departing from the spirit and scope of the invention.

What we claim is:

1. A venting system for a superconducting magnet including a cryogen vent adapter pipe attached to the cryostat and connected to an exhaust vent in the enclosure in which the superconducting magnet is installed in order to vent cryogen gas from the cryostat to the atmosphere outside the enclosure, a floating flange alignment assembly positioned between, and sealing, the cryogen vent adapter and the exhaust vent and accommodating misalignments therebetween comprising:

a flange on said vent adapter;

a vent pipe including a flange proximate to said flange on said vent adapter and with a plurality of openings spaced about the circumference thereof;

the inside of said vent pipe being larger than the inside of said vent adapter;

said openings being larger than the difference between the insides of said vent pipe and said vent adapter;

a resilient seal positioned between the vent adapter flange and the vent pipe flange;

a clamping member positioned on the side of said vent pipe flange remote from said resilient seal; and a plurality of adjustable fasteners extending between said clamping member and said vent pipe flange through said openings to compress said sealing member therebetween and provide a seal between said vent pipe and said vent adapter;

said vent pipe being radially moveable within the limits of movement of said openings about said fasteners to provide adjustable alignment between said vent pipe and said exhaust vent.

2. The cryogen vent alignment apparatus of claim 1 wherein said resilient seal is an O-ring which is compressed by tightening of said fasteners upon the adjusted alignment of said vent pipe and said adapter.

3. The cryogen vent alignment apparatus of claim 2 wherein an annular groove in one of said flanges around the inside thereof is provided, and said O-ring is positioned in said groove.

4. The cryogen vent alignment apparatus of claim 3 wherein said fasteners include a bolt passing through each of said openings and engaging threaded apertures in said clamping member.

5. The cryogen vent alignment apparatus of claim 4 wherein said openings are spaced approximately 45 degrees apart about the axis of said vent adapter.

6. The cryogen vent alignment apparatus of claim 2 wherein said vent pipe is connected to said exhaust vent through a dielectric isolator connector.

7. The cryogen vent alignment apparatus of claim 2 wherein said O-ring is Teflon-coated silicone.

8. The cryogen vent alignment apparatus of claim 1 wherein the dimensions of said openings are in the order of twice the difference between the insides of said cryogen vent and said vent pipe and said openings are dimensioned to prevent any constraint in the flow path between said vent adapter and said vent pipe.

9. The cryogen vent alignment apparatus of claim 8 wherein said openings are slots extending substantially radially about the axis of said vent adapter.

10. The cryogen vent alignment apparatus of claim 9 wherein said slots are in the order of two inches wide in the circumferential direction and in the order of two inches in the radial direction.

11. The cryogen vent alignment apparatus of claim 10 wherein there are in the order of eight slots and eight fasteners.

12. The cryogen vent alignment apparatus of claim 9 wherein said vent pipe is connected to said exhaust vent through a dielectric isolator connector.

* * * * *